US005941436A

United States Patent [19]

Washington et al.

[11] Patent Number: 5,941,436

[45] Date of Patent: Aug. 24, 1999

[54] WEARABLE TRAY ASSEMBLY

[76] Inventors: Darrell Washington; Estrellita Washington, both of 4221 Stone Bridge La., Las Vegas, Nev. 89108

[21] Appl. No.: 09/041,160

[22] Filed: Mar. 12, 1998

[51] Int. Cl.[6] ..... A45F 5/00; A45F 3/04

[52] U.S. Cl. ..... 224/270; 224/259; 224/272; 224/637; 224/649; 224/646; 224/642

[58] Field of Search ..... 224/270, 271, 224/272, 259, 646, 647, 648, 649, 642, 662, 660, 637, 195; 108/43; 248/444

[56] References Cited

U.S. PATENT DOCUMENTS

| | | | |
|---|---|---|---|
| 1,723,147 | 8/1929 | Fourethier | 224/197 |
| 2,289,945 | 7/1942 | Wadsack . | |
| 2,510,646 | 6/1950 | Meers . | |
| 3,090,330 | 5/1963 | Best | 224/270 |
| 3,125,825 | 3/1964 | Gaudette . | |
| 3,541,976 | 11/1970 | Rozas | 108/43 |
| 4,715,293 | 12/1987 | Cobbs . | |
| 5,221,032 | 6/1993 | Bott et al. . | |
| 5,421,499 | 6/1995 | Bauer . | |
| 5,477,997 | 12/1995 | Weatherly | 224/637 |

*Primary Examiner*—Linda J. Sholl
*Attorney, Agent, or Firm*—Kenneth L Tolar

[57] ABSTRACT

The present invention relates to a wearable tray assembly particularly designed for those who stock shelves or perform similar tasks. The device includes a circular, continuous padded waistband having an elongated, integral slot on its front portion. The waistband is supported around a person's abdomen using a pair of adjustable shoulder straps. A planar, substantially rectangular tray member is received within the slot for supporting items, such as a shipping carton, immediately adjacent a user's abdomen. The tray member preferably has at least one retaining wall vertically depending from a peripheral edge to prevent the carton from shifting. Alternatively, a box shaped container member may be attached to the waistband by inserting a pair of opposing, horizontally extending attachment arms into the slot. The tray and container member are supported in a horizontal position using a leg brace removably attached to their respective lower surfaces at one end and to the waistband at a second end.

13 Claims, 3 Drawing Sheets

WEARABLE TRAY ASSEMBLY

BACKGROUND OF THE INVENTION

The present invention relates to a wearable tray assembly specifically designed for assisting those in stocking store shelves or in performing similar tasks requiring frequent bending, reaching and grasping objects.

DESCRIPTION OF THE PRIOR ART

When stocking a shelf, a store clerk typically removes the items one at a time from a cardboard shipping carton and places them on the shelf. Because the packaged items often relate to bottles or cans, the carton is heavy and therefore must be placed on the floor during the stocking process. The store clerk then must bend over and individually transfer the items from the carton to the shelf. The repeated bending and reaching is burdensome, laborious and strenuous.

The task is even further complicated when the objects must be placed on an upper shelf. The store clerk must then individually transfer the items from the box to the upper shelf using a step ladder which is time consuming, inconvenient and tiresome. Although numerous wearable tray assemblies currently exist in the prior art, none of these devices have the unique features and advantages of the present invention nor are they designed to address the above described problems. For example, U.S. Pat. No. 5,421,499 issued to Bower relates to a wearable table having a pair of hook shaped shoulder frames with a foldable table member attached thereto. The device is primarily designed to allow a user to read, write or eat while standing.

U.S. Pat. No. 5,221,032 issued to Bott et al relates to a tray assembly that may be mounted about a person's waist or torso using a belt type fastener. The tray assembly is attached to the belt using a pair of horizontal support rods.

U.S. Pat. No. 4,715,293 issued to Cobbs relates to an instrument desk configured to hold a lap top computer or a similar instrument having a shoulder rest attached thereto.

U.S. Pat. No. 2,289,945 issued to Wadsak discloses a serving tray that fits about a person's shoulders using a pair of hook shaped frames. The frames are selectively collapsible using a hinge.

U.S. Pat. No. 3,125,825 issued to Gaudet relates to a portable table that may be supported on a person's clothing or body. The device comprises a flat portion having an arcuate end configured to conform to the front of a person's body. The flat portion is supported in a substantially horizontal position by inserting a hingedly engaging flap into a user's trousers.

U.S. Pat. No. 2,510,646 issued to Meers relates to a serving tray carrier attachable to a person using a hook member that fits about the person's neck.

Although various tray assemblies supportable on a person's shoulder or torso exist in the prior art, none of these devices relate to a uniquely configured assembly having numerous detachable accessory components specifically designed to assist a user in stocking shelves or in performing similar tasks. The present invention provides a uniquely designed waistband, having an integral rectangular slot, that is supported about a user's torso with a pair of shoulder straps. A flat tray member or a box type container member may be removably attached to the waistband by inserting it into the slot. A leg brace supports the tray member or container member in a substantially horizontal portion. Accordingly, a person stocking store shelves or performing any other task requiring the handling of numerous items may continuously maintain the items within reach.

SUMMARY OF THE INVENTION

The present invention relates to a wearable tray assembly having several detachable components allowing the device to be easily disassembled for transport or storage. The device comprises a padded shoulder harness for resting on a user's shoulders. The shoulder harness includes a pair of opposing straps which are attached to opposing sides of a padded waistband portion for supporting the waistband around a user's torso. Each strap has a plurality of vertically aligned notches for selectively engaging a mating set of rivets on the inner surface of the waistband portion allowing the length of the shoulder straps to be selectively adjusted. Protruding from opposing vertical slots on the front portion of the waistband is an integral belt for tightening the device around a user's abdomen. Immediately below the belt is a substantially rectangular, horizontal slot for receiving and supporting a flat tray member or a box shaped container member.

The tray member preferably has a vertical side wall extending from at least one peripheral edge thereof for retaining a carton or other items when placed on its upper surface. Alternatively, a substantially rectangular box shaped container member may be attached to the waistband portion by inserting attachment arms extending from a side wall thereof into the rectangular slot. Both the container and tray member are supported in a substantially horizontal position with an elongated leg brace an end of which is received within a sleeve on the waistband portion and a second end removably attached to the lower surface of the tray member or container. Accordingly, a shipping carton filled with products may be placed on the tray member and supported immediately adjacent a user's abdomen eliminating the burdensome task of bending over and individually transferring the items from a box resting on the floor. Alternatively, the container member is supported on the waistband and a plurality of items may be stored therein. It is therefore an object of the present invention to provide a wearable tray assembly having a removably attached tray and container component.

It is yet another object of the present invention to provide a wearable tray assembly which allows a user to quickly and conveniently stock a store shelf.

It is yet another object of the present invention to provide a wearable tray assembly that can support a shipping carton or a box immediately adjacent a user's mid torso area.

It is yet another object of the present invention to provide a wearable tray assembly having numerous detachable components allowing the device to be conveniently disassembled and stored when not in use. Other objects, features and advantages of the present invention will become readily apparent from the following detailed description of the preferred embodiment when considered with attached drawings and the appended claims.

DESCRIPTION OF THE PREFERRED EMBODIMENT

Figure 1:
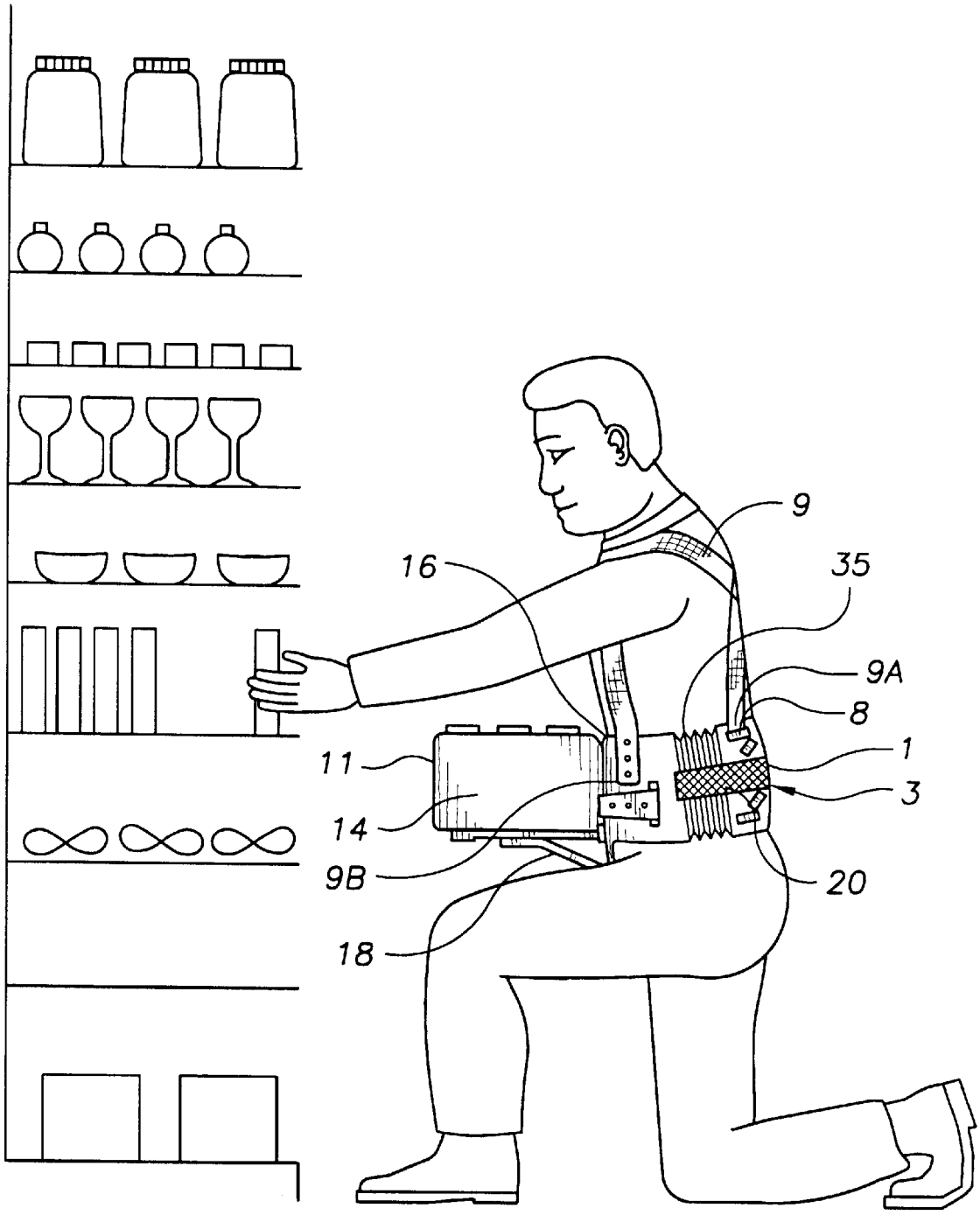
FIG. 1 depicts the inventive device worn by a user.
Figure 2:
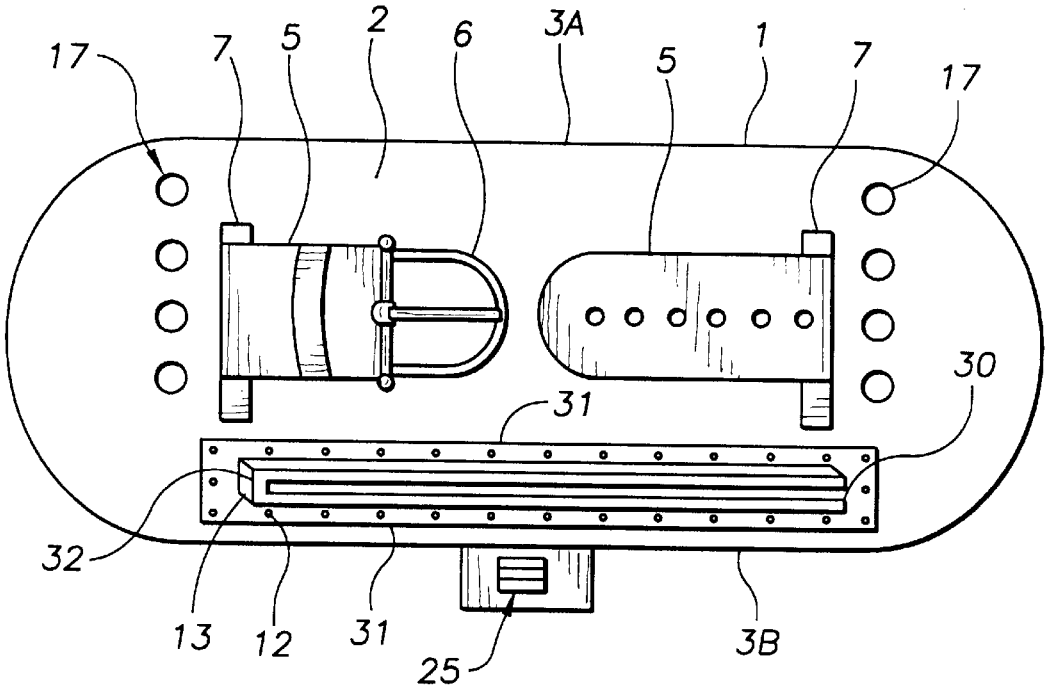
FIG. 2 is a front view of the waistband portion and shoulder straps.
Figure 3:
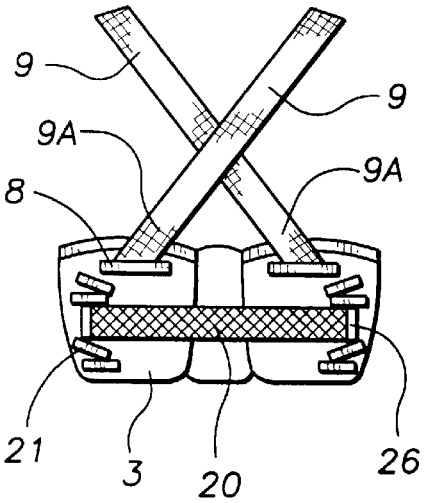
FIG. 3 is a rear view of the waistband portion.
Figure 4:
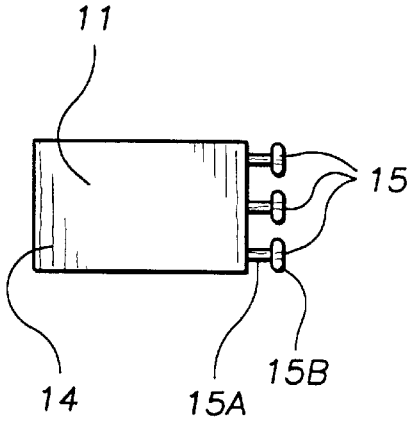
FIG. 4 is a side view of the container component.

Referring now to FIGS. 1 through 5, the present invention relates to a wearable tray assembly specifically designed to assist a user in stocking a store shelf or performing similar tasks that may require frequent bending, reaching and grasping objects. The device comprises a continuous, substantially circular padded waistband 1 for encircling a user's mid torso area having front 2 and rear 3 portions, an inner and an outer surface and an upper 3A and a lower 3B peripheral edge. A pair of opposed, vertical slots 7 are disposed on the front portion projecting from which is an integral peripheral belt 5 that is separable and adjustable with a buckle 6. The adjustable belt 5 allows the waistband to be tightly secured around the abdomen of various size users. The waistband portion further includes accordion style pleats 35 on opposing portions thereof for selectively extending the waistband.

A pair of opposed horizontal slots 8 are disposed on the back portion of the waistband 1 each near the upper edge 3A thereof. A pair of shoulder straps 9 having first 9A and second 9B terminal ends extend from the horizontal slots for supporting the waistband at a predetermined vertical position along a person's torso. The first end 9A of each strap 9 is received within a slot 8 on the rear portion 3 of the waistband. The first ends are secured to the inner surface of the waistband using any conventional attachment means such as Velcro, snaps, buttons, etc. Preferably, the shoulder straps 9 intersect as they extend from the back portion and become substantially parallel as they traverse a user's shoulders. Vertically aligned on each shoulder strap immediately adjacent its second end are a plurality of notches 16 for selectively engaging a plurality of vertically aligned rivets 17 on the outer surface of the waistband. Accordingly, the second ends 9B of the shoulder straps may be tightly secured to the outer surface of the waistband at a desired position by inserting a rivet into a notch on each strap.

Adjacent the lower edge 3B of the waistband portion is a horizontal, substantially rectangular integral slot 13 which is secured to the inner surface of the waistband with rivets 12. The slot preferably has two longitudinal edges 31 and one lateral edge 32 with an open end 30 opposite the lateral edge. The slot 13 is dimensioned to tightly receive a support means such as a tray member 10 or a box shaped container member 11 as described below. Preferably, the slot 13 has an interior back wall parallel to the slot face providing an abutment surface for the tray member preventing it from contacting a user's abdomen.

The tray member 10 is planar, substantially rectangular and has four peripheral edges, an upper surface and a lower surface. Preferably, a retaining wall 22 vertically depends from at least one peripheral edge of the tray member to prevent items resting on its upper surface from shifting. The tray member 10 and accompanying retaining walls 22 are particularly suitable for supporting a shipping carton 23 or a similar container. The tray member 10 is secured to the waistband by inserting a peripheral edge not having a retaining wall depending therefrom into the open end of the slot and sliding it horizontally until it abuts the lateral edge 32.

Alternatively, a container member 11 may be horizontally supported on the waistband. The container member 11 is substantially box shaped and comprises a substantially rectangular bottom surface with four contiguous side walls 14 vertically depending therefrom. Horizontally extending from a side wall 14 are two opposing rows of vertically aligned T-shaped attachment arms 15 each including an elongated horizontal portion 15A and a vertical portion 15B extending therefrom. The container member 11 may be attached to the waistband by inserting the vertical portion 15B of two opposing attachment arms into the elongated slot. The opposing rows of vertically aligned attachment arms allow the height of the container member relative to the waistband to be selectively adjusted.

Figure 5:
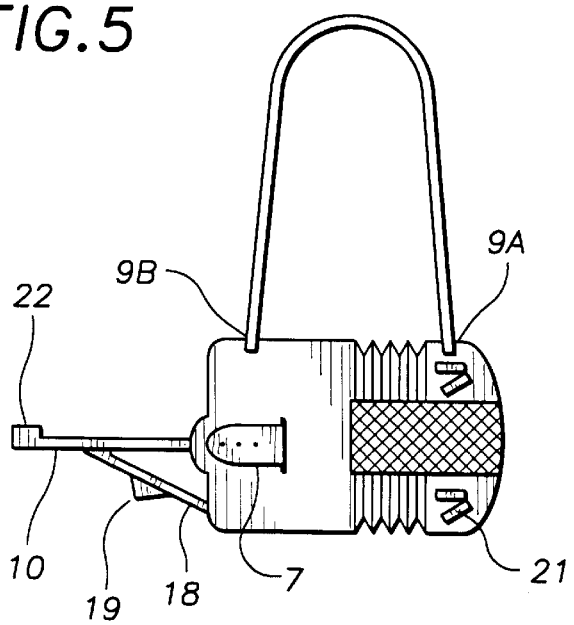
FIG. 5 is a side view of the tray component attached to the waistband.
Figure 6:
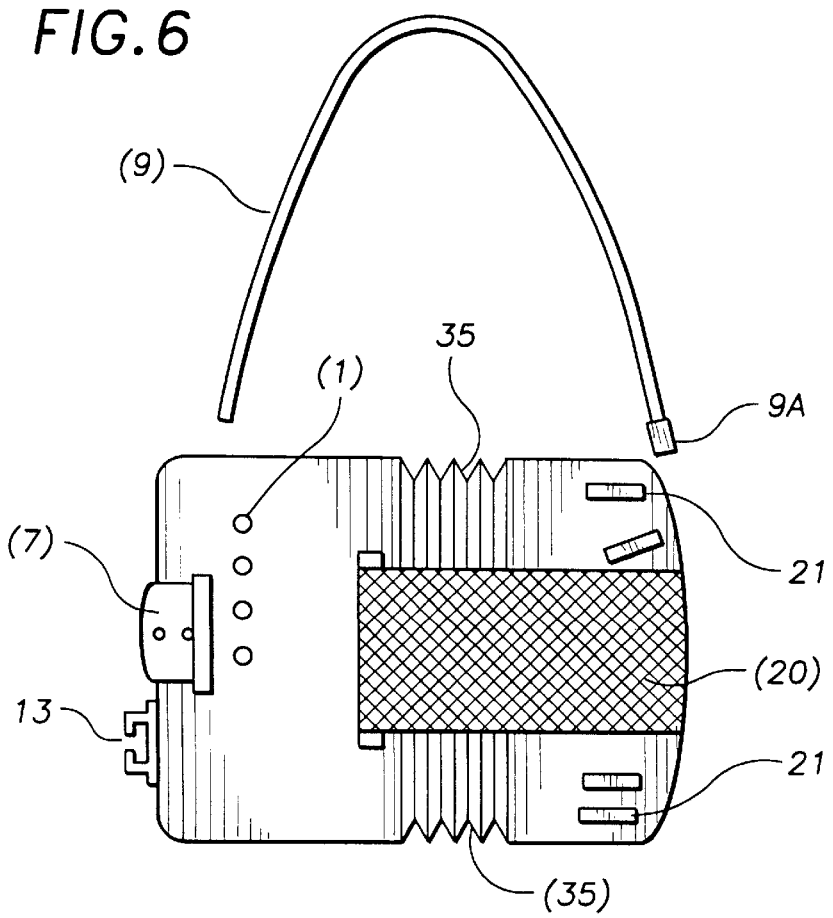
FIG. 6 is a close up side view of the waistband portion.

Immediately below the rectangular slot is a substantially rectangular sleeve 25 dimensioned to removably receive a first end of an elongated leg brace 18. A second end of the leg brace 18 may be removably attached to the lower surface of the container or tray member using any conventional attachment means such as sleeves, screws, bolts, hinges, etc. Preferably, the leg brace 18 also includes a centrally located hinge 19 such as a slide latch hinge allowing the leg brace to be selectively folded or locked into an extended position. The leg brace 18 extends obliquely from the waistband 1 to the bottom surface of the container or tray member for rigidly supporting either in a substantially horizontal position as depicted in FIG. 5.

On the back portion of the waistband is an elongated, horizontal band 20 made from nylon or a similar material for providing additional support to a wearer's back. The band is secured to the waistband with rivets 26. Also, on the back portion are a plurality of opposed pairs of slits 21 each for receiving a shoulder strap allowing the length and position of the straps to be further adjusted.

To use the above described device, a user places the straps 9 about the shoulders and secures the waistband at a desired height by adjusting the shoulder straps using the rivets and mating notches and/or the slits 21. The user then attaches either the tray member or the carton by inserting it into the rectangular slot. If the user wishes to unload items from an existing shipping carton, the tray member is used and the shipping carton is placed thereon. Alternatively, a plurality of items may be placed in the container member which provides a readily accessible, wearable storage receptacle.

The above described device is not to be limited to exact details of construction enumerated above. For example, the device may be used in many other applications other than stocking shelves such as storing paint cans and paint brushes, tools and similar items requiring repeated handling and which cannot be conveniently carried on a person's body. The removable container member is particularly suitable for such applications.

The shoulder straps and waistband are preferably constructed with a padded fabric such as nylon or canvas. The tray member and container member are preferably constructed with plastic or a similar lightweight material. However, as will be readily apparent to those skilled in the art, the materials of construction, dimensions, shapes and colors of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A wearable tray assembly comprising:

a continuous, circular waistband for encircling a user's mid torso area, said waistband having front and back portions with inner and outer surfaces and an upper and a lower peripheral edge, said waistband further including an integral elongated slot on said front portion and a sleeve disposed immediately below said slot;

a pair of opposed straps for resting over a person's shoulders, a first end of which is removably and adjustably attached to the back portion of said waistband and a second end of which is attached to the front portion thereof;

a support means having an upper and a lower surface removably received within said elongated slot for supporting one or more items immediately adjacent a user's abdomen;

an elongated leg brace having two ends, a first of which is received within said sleeve with a second end removably attached to the lower surface of said support means for rigidly supporting said support means in a substantially horizontal position.

2. A wearable tray assembly according to claim 1 wherein said support means comprises a substantially rectangular planar tray member having an upper and lower surface.

3. A wearable tray assembly according to claim 1 further comprising a belt integral with said waistband for tightly securing said waistband around a user's torso.

4. A wearable tray assembly according to claim 1 further comprising:

a plurality of vertically aligned notches adjacent the second end of each strap;

a plurality of vertically aligned rivets for selectively engaging said notches, said rivets vertically disposed on the outer surface of said waistband portion allowing the height of the waistband relative to a user to be selectively adjusted.

5. A wearable tray assembly according to claim 1 wherein said support means comprises:

a box shaped container member having a bottom wall and four side walls vertically depending therefrom;

a plurality of opposing, vertically aligned attachment arms horizontally extending from one of said sidewalls of said container, opposing pairs of which may be removably received within said elongated slot on said waistband.

6. A wearable tray assembly according to claim 1 wherein said waistband has a padded substance integral therewith for providing a comfortable surface to encircle a user's torso.

7. A wearable tray assembly according to claim 1 further comprising a plurality of opposing pairs of slits on the back portion of said waistband for selectively receiving the first ends of said shoulder straps.

8. A wearable tray assembly according to claim 1 wherein said leg brace has a centrally located hinge means for pivoting a first half of said leg brace relative to a second half.

9. A wearable tray assembly according to claim 1 further comprising a horizontal band integral with the back portion of the waistband for providing structural support thereto.

10. A wearable tray assembly according to claim 1 wherein said shoulder straps intersect at a predetermined distance from their respective first ends.

11. A wearable tray assembly according to claim 2 wherein said tray member further comprises a retaining wall vertically depending from a peripheral edge thereof for retaining items on the upper surface of said tray member.

12. A wearable tray assembly according to claim 1 wherein said slot further comprises two longitudinal peripheral edges and one lateral edge with an open end opposite said lateral edge for slidably receiving said support surface opposite said lateral edge.

13. A wearable tray assembly according to claim 1 wherein said waistband portion further includes accordion style pleats on opposing portions thereof allowing said waistband to selectively expand.

* * * * *